US005152224A

United States Patent [19]

Guaraldi

[11] Patent Number: 5,152,224

[45] Date of Patent: Oct. 6, 1992

[54] ISOLATED INK FEED MECHANISM

[75] Inventor: Glenn A. Guaraldi, Kingston, N.H.

[73] Assignee: Harris Graphics Corporation, Dover, N.H.

[21] Appl. No.: 836,199

[22] Filed: Feb. 13, 1992

Related U.S. Application Data

[63] Continuation of Ser. No. 583,074, Sep. 14, 1990, abandoned.

[51] Int. Cl.[5] ..... B41F 31/06; B41F 31/14; B41L 27/16

[52] U.S. Cl. ..... 101/350

[58] Field of Search ..... 101/348-352, 101/207-210, DIG. 32, 14, 355-358, 360-363; 118/258, 259

[56] References Cited

U.S. PATENT DOCUMENTS

| | | | |
|---|---|---|---|
| 2,248,645 | 7/1941 | Schlesinger . | |
| 2,672,093 | 3/1954 | Meyer et al. | 101/350 |
| 3,590,735 | 7/1971 | Treff | 101/350 |
| 3,688,696 | 9/1972 | Treff | 101/350 |
| 4,466,347 | 8/1984 | Difflipp et al. | 101/350 |
| 4,524,692 | 6/1985 | Rodvelt | 101/DIG. 32 X |

FOREIGN PATENT DOCUMENTS

| | | |
|---|---|---|
| 403990 | 1/1934 | United Kingdom . |
| 1472654 | 5/1977 | United Kingdom . |

OTHER PUBLICATIONS

European Search Report, European Application Ser. No. 91113788.

*Primary Examiner*—J. Reed Fisher

*Attorney, Agent, or Firm*—Tarolli, Sundheim & Covell

[57] ABSTRACT

An offset printing apparatus rotates the plate cylinder steadily with a minimum of torsional interference caused by impact of the reciprocating ductor roll with the vibrator roll. The vibrator roll is driven to rotate independently of rotation of the other rolls which lead successively to the plate cylinder.

17 Claims, 4 Drawing Sheets

ISOLATED INK FEED MECHANISM

This is a continuation of copending application Ser. No. 07/583,074, now abandoned, filed on Sep. 14, 1990.

BACKGROUND OF THE INVENTION

The present invention relates to a printing press, and particularly relates to an improved high speed ink feed mechanism for a printing press.

DESCRIPTION OF THE PRIOR ART

A printing press generally comprises a fountain roll which picks up ink from an ink fountain, a plate cylinder which carries an image to be printed, and a plurality of distributor rolls for transferring ink from the fountain roll to the plate cylinder. A ductor roll transfers ink directly from the fountain roll to a first distributor roll which is usually a vibrator roll. Additional distributor rolls transfer the ink further from the vibrator roll to the plate cylinder. In order to pick up ink from the fountain roll and to deposit the ink onto the vibrator roll, the ductor roll is reciprocated between a position in ink transferring relationship with the fountain roll and another position in ink transferring relationship with the vibrator roll.

The fountain roll is driven to rotate with a relatively slow surface speed as it picks up ink from the ink fountain. The plate cylinder is driven to rotate with the relatively high surface speed of the moving web being printed. The vibrator roll and the other distributor rolls are driven on a common gear train with the plate cylinder, and are also driven at a relatively high speed as compared with the fountain roll. The reciprocating ductor roll is rotated through surface engagement with either the fountain roll or the vibrator roll, depending upon its position, and therefore experiences repetitive changes in surface speed. Consequently, the reciprocating ductor roll moves back from the fountain roll to the vibrator roll with a rotating surface speed less than the rotating surface speed of the vibrator roll. Impact of the relatively slowly moving ductor roll surface with the more rapidly moving vibrator roll surface causes a torsional shock at the vibrator roll which momentarily resists rotation of the vibrator roll by the gear train. This shock is transmitted through the gear train to the rotating plate cylinder, and can disrupt transfer of the inked image off of the plate cylinder.

SUMMARY OF THE INVENTION

The present invention provides a printing apparatus in which an inked image is transferred off of a plate cylinder with a minimum of disruption caused by the changing surface speed of a ductor roll.

In accordance with a preferred embodiment of the present invention, a printing apparatus comprises an ink fountain for containing a quantity of ink, a fountain roll for picking up ink from the ink fountain, a first distributor roll, and a movable ductor roll for transferring ink from the fountain roll to the first distributor roll. The ductor roll has a first position in ink transferring relationship with the fountain roll, and a second position not in ink transferring relationship with the fountain roll. A reciprocating means is provided to move the ductor roll between the first and second positions. A second distributor roll is supported in ink transferring relationship with the first distributor roll, and a plate cylinder is provided for carrying an image to be printed.

A first driving means rotatably drives the first distributor roll. A second driving means rotatably drives the second distributor roll and the plate cylinder independently of rotation of the first distributor roll.

The invention prevents the reciprocating ductor roll from disrupting rotation of the plate cylinder, because the plate cylinder is rotatably driven independently of rotation of the distributor roll which is affected by the repetitively changing speed of the reciprocating ductor roll.

The driving means preferably includes a first gear means for driving the first distributor roll, a first motor for driving the first gear means, a second gear means independent of the first gear means for driving the second distributor roll and the plate cylinder, and a second motor for driving the second gear means. This arrangement assures that the gear train which drives the second distributor roll and the plate cylinder will not be affected by the changing speed of the reciprocating ductor roll.

In accordance with another preferred embodiment of the present invention, a printing apparatus comprises an ink fountain for containing a quantity of ink, a fountain roll for picking up ink from the ink fountain, a first distributor roll, and a movable ductor roll for transferring ink from the fountain roll to the first distributor roll. The ductor roll has a first position in ink transferring relationship with the fountain roll but not in ink transferring relationship with the first distributor roll, and a second position in ink transferring relationship with the first distributor roll but not in ink transferring relationship with the fountain roll. A reciprocating means moves the ductor roll between the first and second positions. The printing apparatus also includes a second distributor roll which is spaced from the first distributor roll. A driving means rotatably drives the first distributor roll, and rotatably drives the second distributor roll independently of rotation of the first distributor roll. A swing roll is provided for transferring ink between the first distributor roll and the second distributor roll. The swing roll has an engaged position in ink transferring relationship with both the first and second distributor rolls, and a disengaged position in ink transferring relationship with only one of the first and second distributor rolls. Means are provided for holding the swing roll in the engaged position when the ductor roll is out of the second position, and for holding the swing roll in the disengaged position when the ductor roll is moved into the second position.

This embodiment of the invention also prevents the reciprocating ductor roll from disrupting rotation of the plate cylinder, because the plate cylinder is driven to rotate independently of rotation of the first distributor roll, and consequently is driven to rotate without interference caused by impact of the reciprocating ductor roll against the first distributor roll. Additionally, the swing roll is held in the disengaged position to be out of ink transferring relationship with the second distributor roll when the ductor roll impacts the first distributor roll. This assures that the torsional shock will not be transmitted between the first and second distributor roll surfaces.

In accordance with an additional preferred embodiment of the present invention, a printing apparatus comprises an ink fountain for containing a quantity of ink, a fountain roll for picking up ink from the ink fountain, a first distributor roll, and a second distributor roll. A movable ductor roll transfers ink from the fountain roll to the first distributor roll, and is supported in continuous ink transferring relationship with the first distributor roll. The ductor roll has a first position in ink transferring relationship with the fountain roll, and a second position not in ink transferring relationship with the fountain roll. A means is provided to move the ductor roll between the first and second positions. A swing roll is provided to transfer ink from the first distributor roll to the second distributor roll. The swing roll is supported in continuous ink transferring relationship with the first distributor roll. The swing roll is movable between a first position not in ink transferring relationship with the second distributor roll and a second position in ink transferring relationship with the second distributor roll. A holding means is provided to hold the swing roll out of the second position when the first ductor roll is in the first position. Preferably, the ductor roll and the swing roll are supported together on a frame which pivots about the axis of the first distributor roll to move the ductor roll and the swing roll between their respective positions. This alternate embodiment of the invention also prevents the ductor roll from disrupting rotation of the plate cylinder, because the swing roll is held out of ink transferring relationship with the second distributor roll when the ductor roll is experiencing a reduction in speed as a result of surface contact with the more slowly moving fountain roll.

BRIEF DESCRIPTION OF THE DRAWINGS

These and other features of the invention will become apparent to those skilled in the art to which the invention relates upon reading the following description of the preferred embodiments in view of the accompanying drawings, wherein.

DESCRIPTION OF THE PREFERRED EMBODIMENTS

Figure 1:
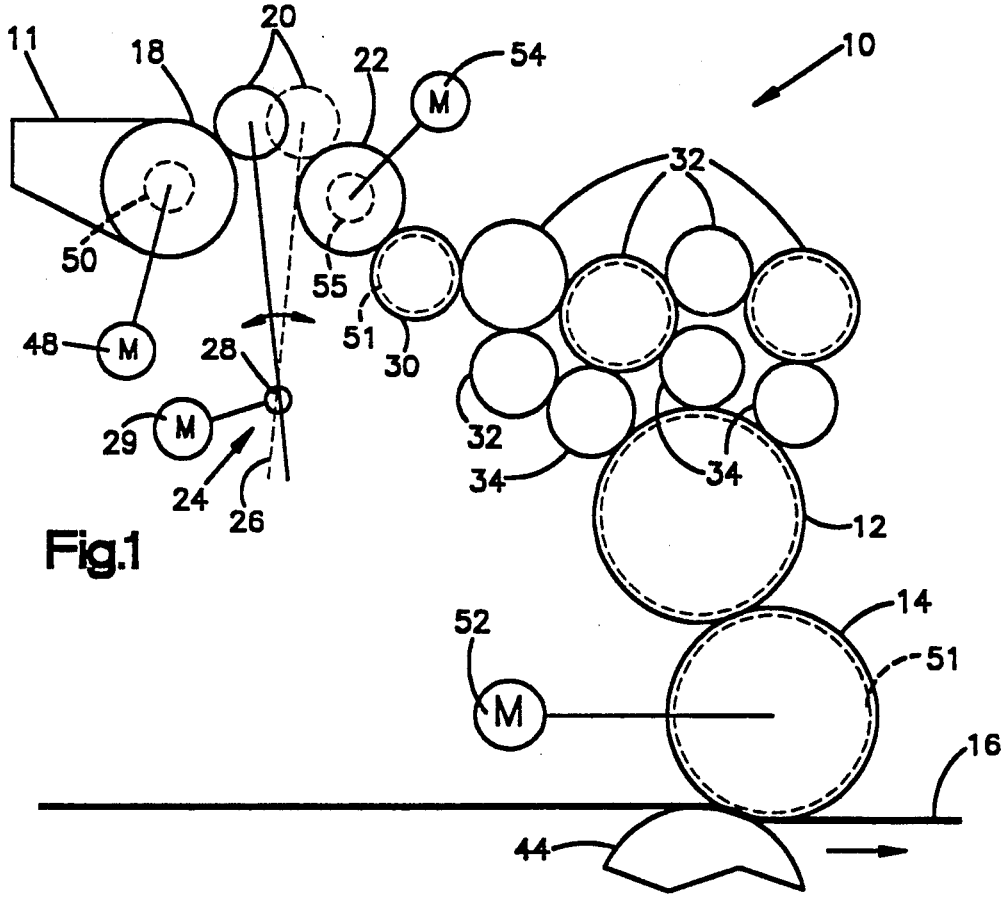
FIG. 1 is a schematic side view of a printing apparatus in accordance with the invention.

A printing apparatus in accordance with the present invention is illustrated schematically in FIG. 1. The printing apparatus 10, by way of example, is an offset printing press comprising a plurality of rolls for transferring ink from an ink fountain 11 to a plate cylinder 12 which carries an image to be printed. A blanket cylinder 14 transfers the inked image from the plate cylinder 12 to a moving paper web 16.

A fountain roll 18 picks up ink from the ink fountain 11. A ductor roll 20 is reciprocated between the fountain roll 18 and a first distributor roll 22 in order to transfer ink from the fountain roll 18 to the first distributor roll 22.

The ductor roll 20 is moved between the fountain roll 18 and the first distributor roll 22 by a reciprocating mechanism 24. As shown schematically in FIG. 1, the reciprocating mechanism 24 comprises a pivotal arm 26 which carries the ductor roll 20 and which is supported for pivotal movement on a hub 28. A reciprocating motor 29 moves the pivotal arm 26 about the hub 28 to move the ductor roll 20 repeatedly in a cycle between the fountain roll 18 and the first distributor roll 22.

A second distributor roll 30 and a series of additional distributor rolls 32 transfer ink from the first distributor roll 22 to a group of form rolls 34, which, in turn, transfer the ink to the plate cylinder 12. A second blanket cylinder 44 is shown only partially in FIG. 1 to represent a second printing apparatus for printing simultaneously on the opposite side of the paper web 16.

The printing apparatus 10 also includes a plurality of driving means comprising motors and gears for rotating the various rolls. Gears associated with the various rolls are represented schematically in the Figures by dotted circular lines. Individual gears and assemblies of gears for rotating the rolls may be constructed in a conventional manner known to those of ordinary skill in the art. A fountain roll motor 48 drives a gear assembly 50 which rotates the fountain roll 18 with a relatively slow surface speed to pick up ink from the ink fountain 11. The second distributor roll 30, two of the additional distributor rolls 32, the plate cylinder 12, and the blanket cylinder 14 are connected by a common gear train 51 to be rotated together. The common gear train 51 is separate from the gear assembly 50. A gear train motor 52 drives the common gear train 51 so that each connected roll rotates with a surface speed approximately equal to the speed of the moving paper web 16. A distributor roll motor 54 drives another gear assembly 55 to rotate the first distributor roll 22 with a surface speed approximately equal to the speed of the moving paper web. Importantly, the distributor roll motor 54 and the associated gear assembly 55 rotate the first distributor roll 22 separately and independently from rotation of the second distributor roll 30 and the other rolls which are driven on the gear train 51 common to the plate cylinder 12. The form rolls 34 and three of the additional distributor rolls 32 are rotated by driven rolling engagement with the surfaces of the adjacent rolls that are rotated on the gear train 51. The condition of driven rolling engagement is understood to include a film of ink between the engaged roll surfaces.

In operation of the printing apparatus 10, the reciprocating mechanism 24 moves the ductor roll 20 back and forth between a first position shown in solid lines in FIG. 1, and a second position shown in dashed lines. When in the first position, the surface of the ductor roll 22 is in ink transferring relationship with the surface o the fountain roll 18. The surface of the ductor roll 22 is also in driven rolling engagement with the surface of the fountain roll 18 to be rotated by the fountain roll 18. The ductor roll 20 is held in the first position by the reciprocating mechanism 24 to pick up a quantity of ink, and is then moved to the second position. When in the second position, the surface of the ductor roll 20 is in ink transferring relationship with the surface of the first distributor roll 22. The ductor roll 20 is likewise held in driven rolling engagement with the first distributor roll 22 when in the second position to be rotated by the first distributor roll 22. Ink is thereby transferred from the ductor roll 20 onto the first distributor roll 22 for subsequent distribution to the plate cylinder 12 and the blanket cylinder 14. A duct cycle is completed as the ductor roll 20 is moved back to the first position in ink transferring relationship with the fountain roll 18 to replenish the supply of ink carried on the ductor roll 20.

As the ductor roll 20 is driven by the relatively slowly rotating fountain roll 18 when in the first position, it reaches a rotating surface speed which is less than the rotating surface speed of the first distributor roll 22. When the ductor roll 20 is moved into the second position to be in ink transferring relationship and driven rolling engagement with the first distributor roll 22, the first distributor roll 22 accelerates the ductor roll 20 toward the greater rotating surface speed of the first distributor roll 22. Impact of the slowly moving ductor roll surface against the more rapidly moving distributor roll surface generates a torsional shock which resists the steady rotation of the first distributor roll 22. This torsional shock is transmitted into the gear assembly 55 which is driven by the distributor roll motor 54. The reciprocating ductor roll 20 has this effect on the first distributor roll 22 and the gear assembly 55 each time it is moved into engagement with the first distributor roll 22.

In accordance with the invention, the second distributor roll 30 and the subsequent rolls which transfer ink from the second distributor roll 30 to the plate cylinder 12 are rotated together on the common gear train 51 independently of rotation of the first distributor roll 22 on the gear assembly 55. Independent rotation of the first and second distributor rolls 22 and 30 isolates the second distributor roll 30 and the subsequent rolls from the torsional shock which is generated upon impact of the reciprocating ductor roll 20 with the first distributor roll 22. This assures that the inked image will be transferred off of the plate cylinder 12 steadily without disruption caused by the repetitive impacts of the reciprocating ductor roll 20.

Figure 2:
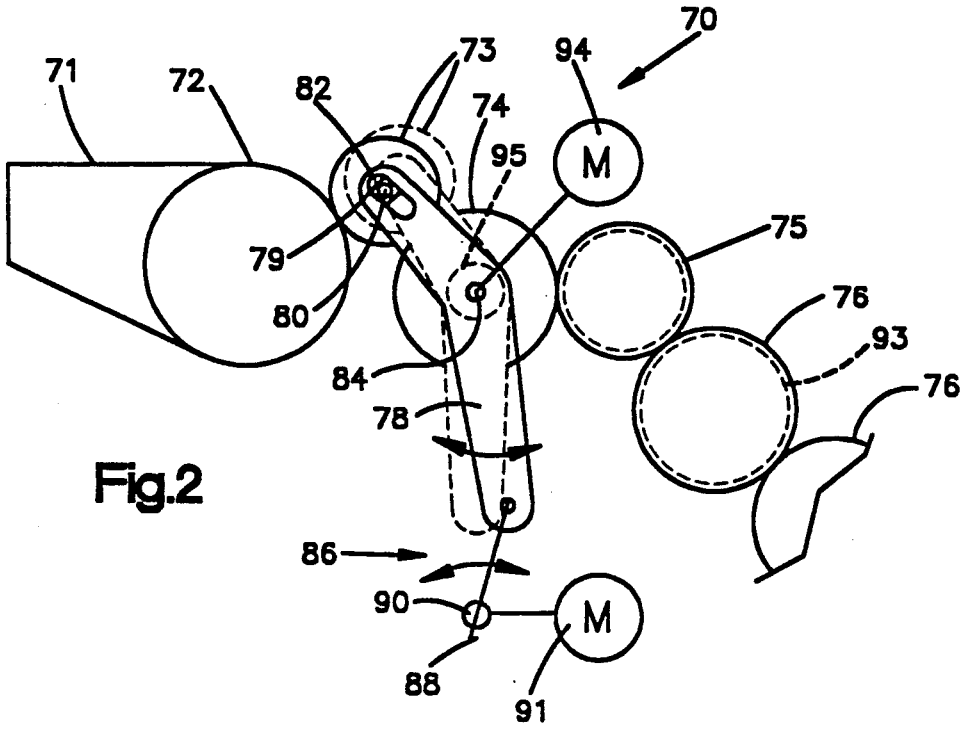
FIG. 2 is a schematic partial side view of a printing apparatus in accordance with an alternate embodiment of the invention.

A printing apparatus 70 in accordance with an alternate embodiment of the present invention is illustrated schematically in FIG. 2. The printing apparatus 70 comprises an ink fountain 71 with a fountain roll 72, a ductor roll 73, first and second distributor rolls 74 and 75, and additional distributor rolls 76 which lead to a plate cylinder (not shown).

The ductor roll 73 is supported by a frame 78 at a position in continuous ink transferring relationship with the first distributor roll 74. An adjusting means comprises a bearing member 79 in which a stub shaft 80 of the ductor roll 73 is journalled. The bearing member 79 is adjustably locatable in a slot 82 in the frame 78 to adjust the supported position of the ductor roll 73 radially with respect to the first distributor roll 74. Adjustment of the ductor roll 73 on the frame 78 controls the degree to which the surface of the ductor roll 73 is pressed into driven rolling engagement with the surface of the first distributor roll 74.

The frame 76 is supported to be pivotal about the axis 84 of the first distributor roll 74, and is associated with a reciprocating mechanism 86 to be moved between a first position shown in dashed lines and a second position shown in solid lines. As shown schematically in FIG. 2, the reciprocating mechanism 86 comprises a pivotal arm 88 which is connected to the frame 78 and is supported for pivotal movement on a hub 90. A reciprocating motor 91 moves the pivotal arm 88 about the hub 90 to move the frame 78 repeatedly in cycles between the first and second positions. The ductor roll 73 is held in ink transferring relationship and driven rolling engagement with the fountain roll 72 when the frame 78 is in the first position, and is held out of ink transferring relationship and driven rolling engagement with the fountain roll 72 when the frame 78 is in the second position.

The printing apparatus 70 further includes means for rotating the rolls. A gear train motor (not shown) drives a gear train 93 for rotation of the second distributor roll 75 and various additional distributor rolls 76 together with rotation of the plate cylinder. A separate distributor roll motor 94 drives a separate gear assembly 95 to rotate the first distributor roll 74 independently of the rolls which are driven on the gear train 93 by the gear train motor.

The ductor roll 73 transfers ink onto the first distributor roll 74 as it is rotated in driven rolling engagement with the first distributor roll 74. When the frame 78 moves back from the second position to the first position to move the ductor roll 73 into driven rolling engagement with the fountain roll 72, the slowly moving surface of the fountain roll 72 exerts a resistance against the more rapidly moving surface of the ductor roll 73. This generates a torsional shock where the surface of the ductor roll 73 is engaged with the surface of the first distributor roll 74. The torsional shock is transmitted to the first distributor roll 74 and into the gear assembly 95 which rotates the first distributor roll 74. Since the second distributor roll 75 is driven to rotate independently of rotation of the first distributor roll 74, the torsional shock is not transmitted to the second distributor roll 75 and further through the gear train 93 to the plate cylinder. Torsional shocks generated by repetitive impacts of the ductor roll 73 with the fountain roll 72 therefore do not disrupt the smooth transfer of the inked image off of the plate cylinder.

Additionally, the adjusting means enables the pressure between the engaged surfaces of the ductor roll 73 and the first distributor roll 74 to be adjusted such that the ductor roll 73 is rotatably driven by the first distributor roll 74, but is permitted to slip in a controlled amount with respect to the first distributor roll 74 in response to the resistance of the slowly moving fountain roll 72 when the ductor roll 73 is in the first position. The degree to which the first distributor roll 74 drives the ductor roll 73 through rolling surface engagement is thereby reduced by slippage experienced upon impact of the ductor roll 73 with the fountain roll 72. This reduces the torsional shock between the engaged surfaces of the ductor roll 73 and the first distributor roll 74. A reduction in the magnitude of the torsional shock also serves to prevent disruption of the rotating plate cylinder, because an excessive shock could be transferred between the surfaces of the first and second distributor rolls 74 and 75 which are closely spaced in ink transferring relationship.

Figure 3:
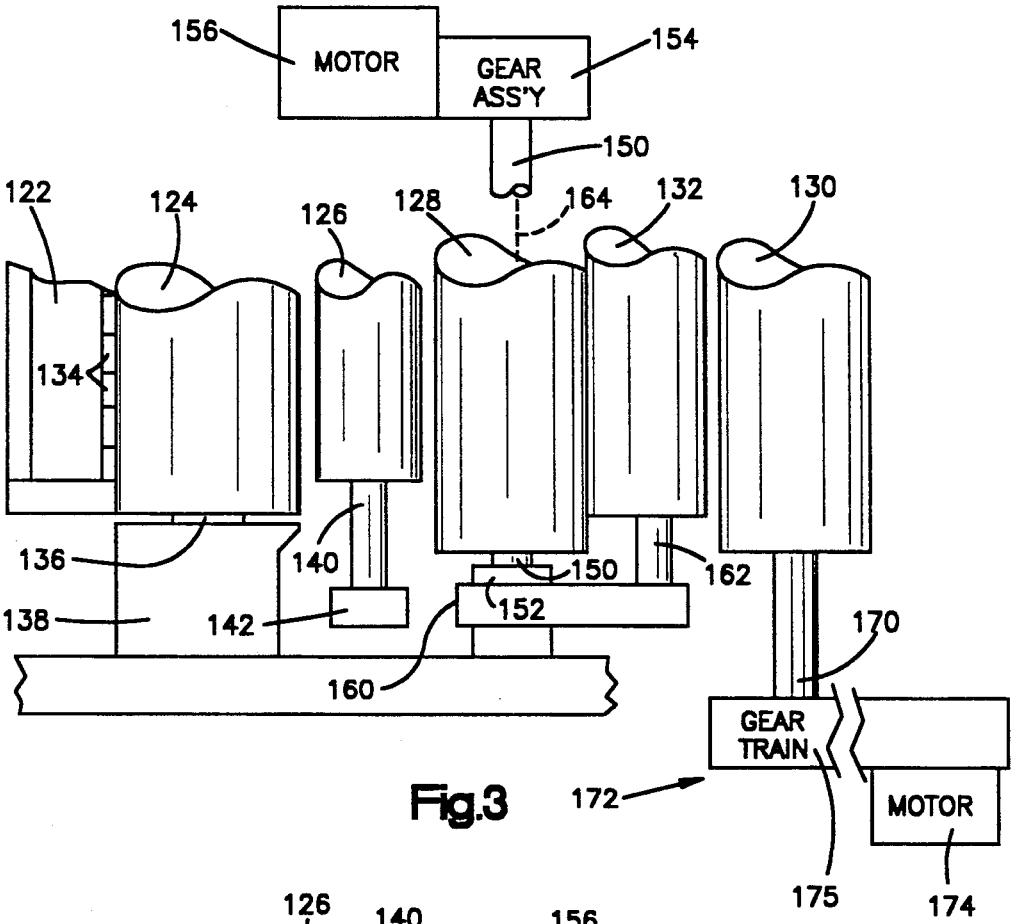
FIG. 3 is a schematic partial top view of a printing apparatus in accordance with another alternate embodiment of the invention.
Figure 4:
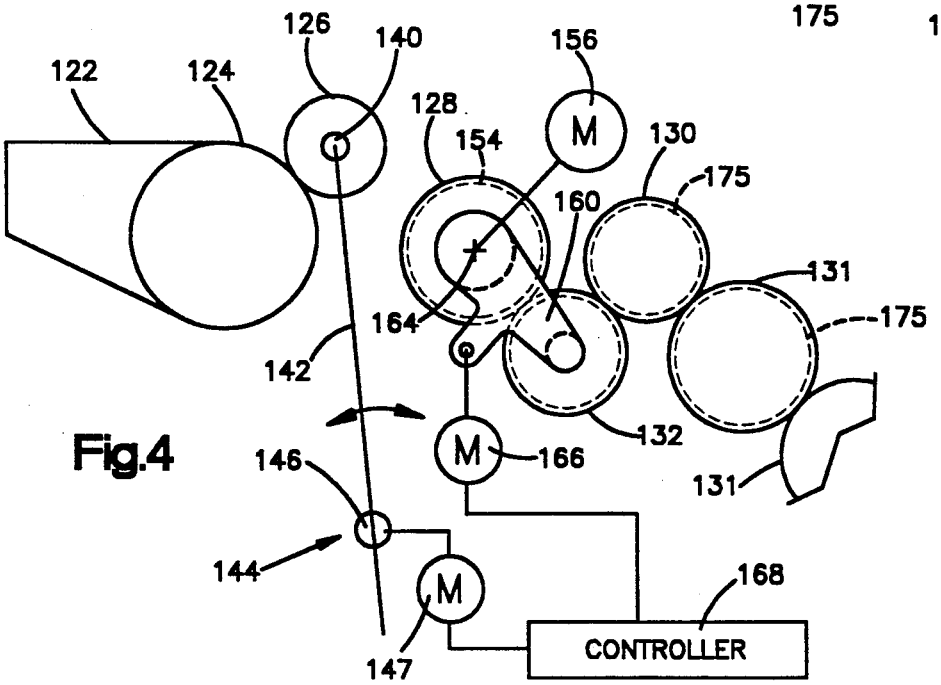
FIG. 4 is a side view of the printing apparatus of FIG. 3
Figure 5:
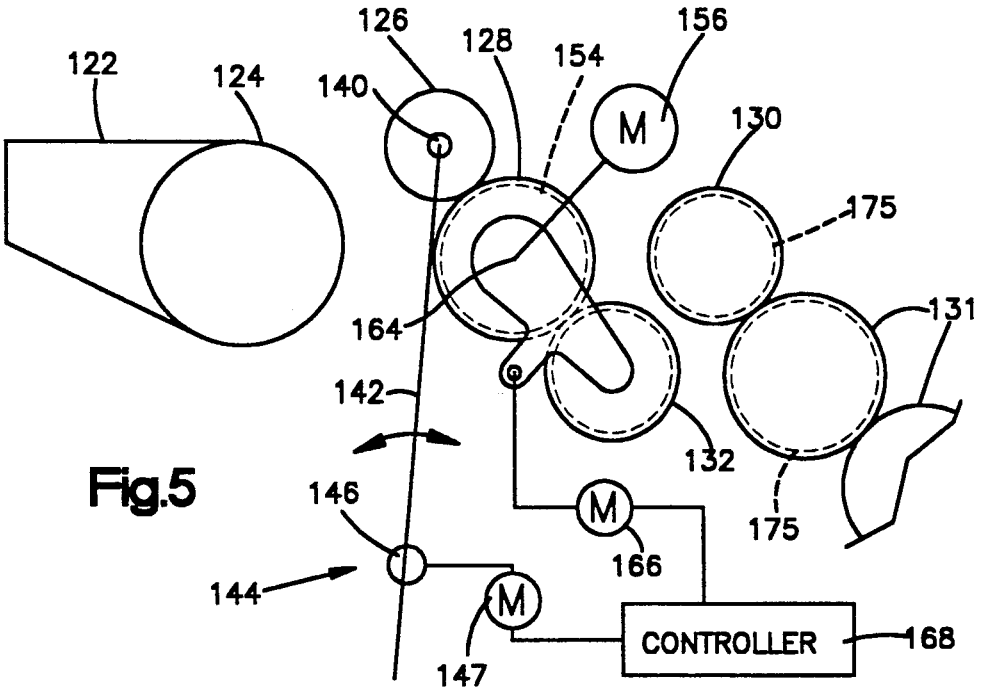
FIG. 5 is a view of the printing apparatus of FIG. 4 in a shifted position.

Another alternate embodiment of the invention is shown in FIGS. 3–5. A printing apparatus 120 comprises an ink fountain 122 with a fountain roll 124, a ductor roll 126, a first distributor roll 128, and a second distributor roll 130 spaced apart from the first distributor roll 128. The printing apparatus 120 further comprises successive rolls 131 leading to a plate cylinder (not shown), and a swing roll 132.

The ink fountain 122 contains a quantity of ink and is equipped with metering blades 134 in a known manner. The fountain roll 124 has an axle 136 supported by a fountain roll driving assembly 138 which includes a motor and gears in a conventional manner.

The ductor roll 126 has a axle 140 supported on a pivotal arm 142 of a reciprocating mechanism 144 (FIGS. 4 and 5). The pivotal arm 142 is supported on a hub 146, and is driven to pivot about the hub 146 by a reciprocating motor 147 in order to move the ductor roll 126 between positions alternately in ink transferring relationship with the fountain roll 124 and the first distributor roll 128.

The first distributor roll 128 has an axle 150 which is supported at one end by a bearing structure 152, and at the other end by a gear assembly 154. The gear assembly 154 is driven by a first distributor roll motor 156 to rotate the first distributor roll 128.

A movable frame 160 supports the axle 162 of the swing roll 132 to hold the swing roll 132 in continuous ink transferring relationship with the first distributor roll 128. The frame 160 may hold the swing roll 132 in driven rolling engagement with the first distributor roll 128, or may include a gear assembly for driving the swing 700 roll 132 to rotate with the first distributor roll 128 as driven by the first distributor roll motor 156. The frame 160 is supported on the bearing structure 152 to be pivotal about the axis 164 of the first distributor roll 128. As shown schematically in FIGS. 4 and 5, a frame motor 166 is provided to move the frame 160 about the axis 164, and a controller 168 is pivoted to coordinate movement of the frame 160 by the frame motor 168 with movement of the ductor roll 126 by the ductor roll motor 147. Alternately, a mechanical linkage could be provided to coordinate movements of a pivotal arm 142 and a frame 160.

The second distributor roll 130 has an axle 170 supported by a driving assembly 172. The driving assembly 172 comprises a second distributor roll motor 174 and a gear train 175 for driving the second distributor roll 130, various successive rolls 131, and the plate cylinder. Those rolls are thereby rotated independently of rotation of the first distributor roll 128 and the swing roll 130.

In operation of the printing apparatus 120, the ductor roll 126 is reciprocated between a first position in ink transferring relationship with the fountain roll 124 (FIG. 4) and a second position in ink transferring relationship with the first distributor roll 128 (FIG. 5). As in the first embodiment of the invention described above, the reciprocating ductor roll 126 encounters the first distributor roll 128 with a rotating surface speed less than the rotating surface speed of the first distributor roll 128. Impact of the more slowly moving ductor roll surface against the more rapidly moving distributor roll surface generates a torsional shock which resists the steady rotation of the first distributor roll 128. Since the first distributor roll 128 is driven by the gear assembly 154 to rotate independently of rotation of the second distributor roll 132, the successive rolls 131, and the plate cylinder, the torsional shocks generated by repetitive impacts of the ductor roll 126 against the first distributor roll 128 are not transmitted into the gear train 175 which drives the plate cylinder. The inked image is therefore transferred off of the plate cylinder without disruption caused by impact of the ductor roll 126 with the first distributor roll 128.

Additionally, movement of the swing roll 132 on the frame 160 serves to avoid transmission of a torsional shock from the surface of the first distributor roll 128 to the surface of the second distributor roll 130. The swing roll 132 has an engaged position in ink transferring relationship with both the first and second distributor rolls 128 and 130 (FIG. 4) to bridge the space between those rolls, and a disengaged position wherein the swing roll 132 is held out of ink transferring relationship with the second distributor roll 130 (FIG. 5) to open the space between those rolls. The controller 168 causes the frame motor 166 to move the frame 160 such that the swing roll 132 is held out of the engaged position when the ductor roll 126 is moved against the surface of the first distributor roll 128. The swing roll is then moved into the engaged position after the torsional shock caused by impact of the ductor roll 126 is dissipated. The torsional shock may dissipate through the gear assembly 154 before the ductor roll 126 is moved back out of engagement with the first distributor roll 128, and movement of the swing roll 132 on the frame 160 can be coordinated accordingly.

Figure 6:
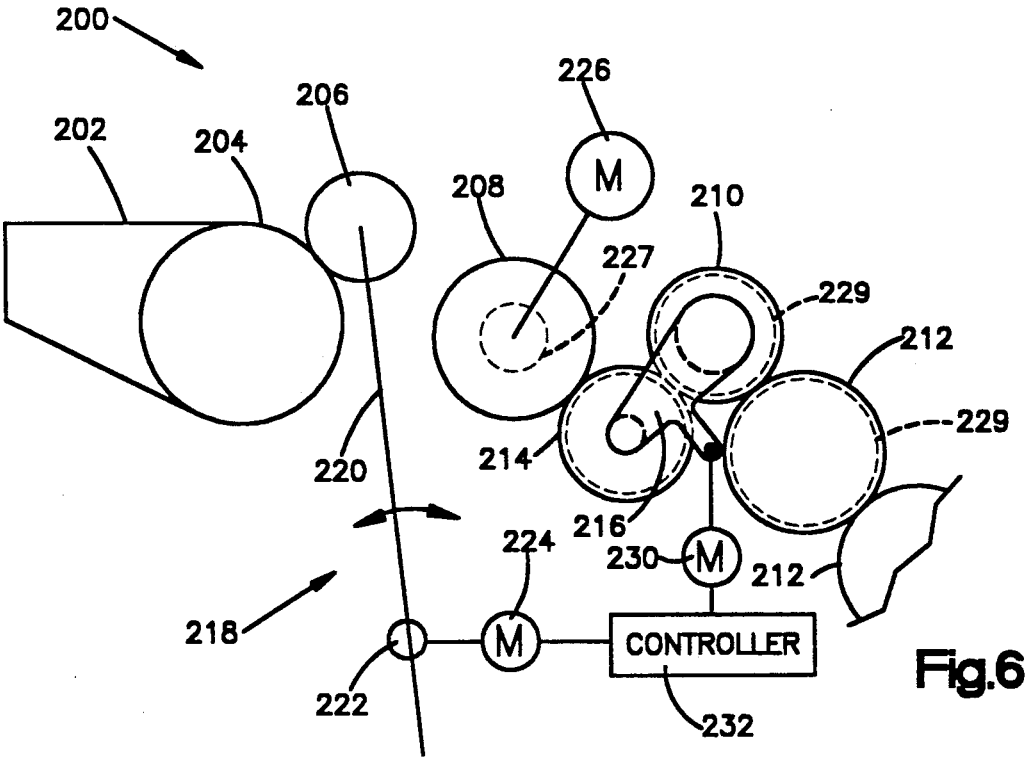
FIG. 6 is a schematic partial side view of a printing apparatus in accordance with another alternate embodiment of the invention.
Figure 7:
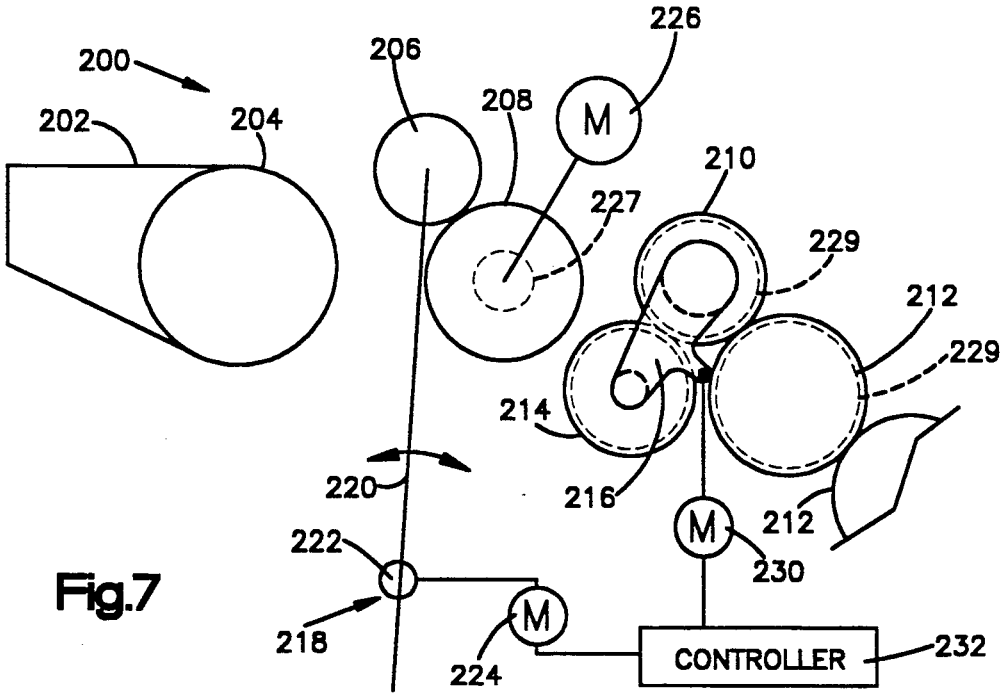
FIG. 7 is a view of the printing apparatus of FIG. 6 in a shifted position.

Yet another embodiment of the invention is shown in FIGS. 6 and 7. A printing apparatus 200 comprises an ink fountain 202 with a fountain roll 204, a ductor roll 206, and spaced apart first and second distributor rolls 208 and 210. The printing apparatus 200 also includes additional distributor rolls 212 leading from the second distributor roll 210 to a plate cylinder, and a swing roll 214 carried on a movable frame 216.

The ductor roll 206 is supported on a reciprocating mechanism 218 which comprises a pivotal arm 220, a hub 222 and a ductor roll motor 224 for moving the pivotal arm 220 about the hub 222.

A first distributor roll motor 226 rotates the first distributor roll 208 through a gear assembly 227. A second distributor roll motor (not shown) drives the second distributor roll 210, various additional distributor rolls 212, and the plate cylinder together through a common gear train 229 which is separate from the gear assembly 227 driven by the first distributor roll motor 226. Torsional shocks imparted to the first distributor roll 208 by the ductor roll 206 are thereby isolated from the gear train 229 which drives the plate cylinder.

A frame motor 230 moves the frame 216 to carry the swing roll between an engaged position in ink transferring relationship with both the first and second distributor rolls 208 and 210 (FIG. 6), and a disengaged position wherein the swing roll is out of ink transferring relationship with the first distributor roll 208 (FIG. 7). The printing apparatus 200 shown in FIGS. 6 and 7 differs from the printing apparatus 120 shown in FIGS. 3–5 in that the frame 216 is supported to be pivotal about the axis of the second distributor roll 210 as opposed to being pivotal about the axis of the first distributor roll 208. However, a controller 232 coordinates movement of the swing roll 214 with movement of the ductor roll 206 similarly to the controller 168 in order to avoid transmission of a torsional shock from the surface of the first distributor roll 208 through the swing roll 214 to the surface of the second distributor roll 210.

Figure 8:
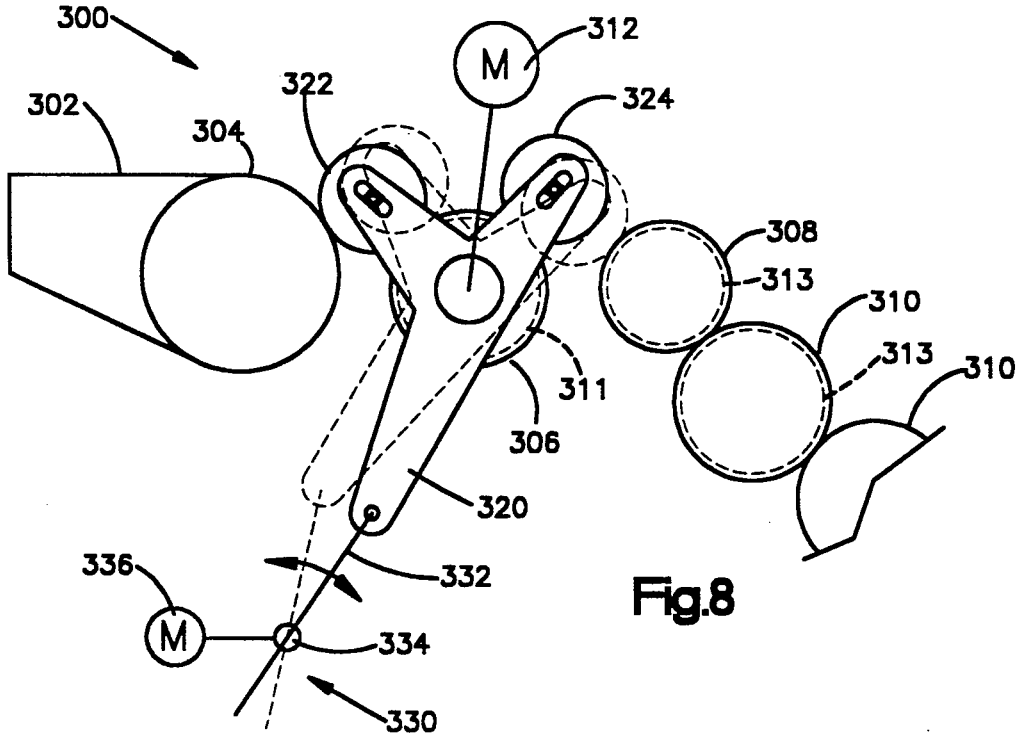
FIG. 8 is a schematic partial side view of a printing apparatus in accordance with an additional alternate embodiment of the invention.

A printing apparatus 300 in accordance with another alternate embodiment of the invention is shown in FIG. 8. The printing apparatus 300 comprises an ink fountain 302 with a fountain roll 304, a first distributor roll 306, a second distributor roll 308 spaced from the first distributor roll 306, and additional distributor rolls 310 which lead to a plate cylinder. The first distributor roll 306 is rotated by a gear assembly 311 which is driven by a first motor 312. The second distributor roll 308, the additional distributor rolls 310, and the plate cylinder are rotated by a gear train 313 which is driven by a second motor (not shown). The gear train 313 is separate from the gear assembly 311 which rotates the first distributor roll 306.

A movable frame 320 supports both a ductor roll 322 and a swing roll 324 in continuous ink transferring relationship, and in driven rolling engagement, with the first distributor roll 306. A pair of adjusting assemblies 326 enable adjustment of the degree to which the ductor roll 322 and the swing roll 324 are held in driven rolling engagement with the first distributor roll 306.

The movable frame member 320 is supported for pivotal movement about the axis of the first distributor roll 306, and is associated with a reciprocating mechanism 330 to be moved between a first position shown in solid lines and a second position shown in dashed lines. The reciprocating mechanism 330 comprises a pivotal arm 332 which is connected to the frame 320 and is supported for pivotal movement on a hub 334. A reciprocating motor 336 moves the pivotal arm 332 about the hub 334 to move the frame 320 repeatedly in cycles between the first and second positions. When the frame 320 is in the first position, the ductor roll 322 is in ink transferring relationship with the fountain roll 304 to pick up a quantity of ink, and the swing roll 324 is spaced from the second distributor roll 308. When the frame 320 is in the second position, the ductor roll 322 is out of ink transferring relationship with the fountain roll 304, and the swing roll 324 is in ink transferring relationship with the second distributor roll 308 to bridge the space between the first and second distributor rolls 306 and 308. As the reciprocating motor 326 moves the frame 320 to move the ductor roll 322 into and out of ink transferring relationship with the fountain roll 304, the swing roll 324 is moved oppositely out of and into ink transferring relationship with the second distributor roll 308. The swing roll is thereby held away from the second distributor roll 308 when rotation of the ductor roll 322 by the first distributor roll 306 is being resisted by the more slowly rotating fountain roll 304, and the surface of the second distributor roll 308 is isolated from that resistance to rotation. The plate cylinder which is rotated on the gear train 313 with the second distributor roll 308 is in turn isolated from resistance to rotation caused by the ductor roll 322.

From the above description of a preferred embodiment of the invention, those skilled in the art will perceive improvements, changes and modifications. Such improvements, changes and modifications within the skill of the art are intended to be covered by the appended claims.

Having thus described the invention, it is claimed:

1. A printing apparatus comprising:

an ink fountain for containing a quantity of ink;

a fountain roll for picking up ink from said ink fountain;

a first distributor roll;

a movable ductor roll for transferring ink from said fountain roll to said first distributor roll, said ductor roll having a first position in rolling engagement with said fountain roll to be rotated by said fountain roll at a first speed, said ductor roll having a second position spaced from said fountain roll and in rolling engagement with said first distributor roll to be rotated by said first distributor roll at a second speed greater than said first speed;

means for moving said ductor roll between said first and second positions;

a second distributor roll for receiving ink from said first distributor roll;

a plate cylinder for carrying an image to be printed and to which ink from said ink fountain is transferred by said fountain roll, said ductor roll, and said first and second distributor rolls;

a first driving means comprising a first motor for rotating said first distributor roll; and a second driving means separate from said first driving means, said second driving means comprising a second motor for rotating said second distributor roll and said plate cylinder.

2. A printing apparatus as defined in claim 1 wherein said first driving means comprising a first gear means for rotating said first distributor roll, said first motor driving said first gear means, said second driving means comprising a second gear means separate from said first gear means for rotating said second distributor roll and said plate cylinder, said second motor driving said second gear means.

3. A printing apparatus as defined in claim 1 wherein said ductor roll is out of ink transferring relationship with said first distributor roll when in said first position.

4. A printing apparatus as defined in claim 1 wherein said second distributor roll is supported in continuous ink transferring relationship with said first distributor roll.

5. A printing apparatus comprising:

an ink fountain for containing a quantity of ink;

a fountain roll for picking up ink from aid ink fountain;

a first distributor roll;

a movable ductor roll for transferring ink from said fountain roll to said first distributor roll, said ductor roll having a first position in rolling engagement with said fountain roll to be rotated by said fountain roll at a first speed, said ductor roll having a second position spaced from said fountain roll and in rolling engagement with said first distributor roll to be rotated by said first distributor roll at a second speed greater than said first speed, said ductor roll being supported in continuous ink transferring relationship with said first distributor roll;

means for moving said ductor roll between said first and second positions;

a plate cylinder for carrying an image to be printed and to which ink from said ink fountain is transferred by said fountain roll, said ductor roll, and said first and second distributor rolls;

a second distributor roll for receiving ink from said first distributor roll;

a first driving means comprising a first motor for rotating said first distributor roll; and a second driving means separated from said first driving means, said second driving means comprising a second motor for rotating said second distributor roll and said plate cylinder.

6. A printing apparatus as defined in claim 5 wherein said first distributor roll has an axis, said ductor roll being supported on a frame, said frame being pivotal about said axis, said means for moving said ductor roll between said first and second positions including means for pivotally moving said frame about said axis.

7. A printing apparatus as defined in claim 5 wherein said first driving means comprising a first gear means for rotating said first distributor roll, said first motor driving said first gear means, said second driving means comprising a second gear means separate from said first gear means for rotating said second distributor roll and said plate cylinder, said second motor driving said second gear means.

8. A printing apparatus comprising:

an ink fountain for containing a quantity of ink;

a fountain roll for picking up ink from said ink fountain;

a first distributor roll;

a movable ductor roll for transferring ink from said fountain roll to said first distributor roll, said ductor roll having a first position spaced from said first distributor roll and in rolling engagement with said fountain roll to be rotated by said fountain roll at a first speed, said ductor roll having a second position spaced from said fountain roll and in rolling engagement with said first distributor roll to be rotated by said first distributor roll at a second speed greater than said first speed;

means for moving said ductor roll between said first and second positions;

a second distributor roll for receiving ink from said first distributor roll, said second distributor roll being spaced from said first distributor roll;

a plate cylinder for carrying an image to be printed and to which ink from said ink fountain is transferred by said fountain roll, said ductor roll, and said first and second distributor rolls;

a first driving means comprising a first motor for rotating said first distributor roll;

a second driving means separated from said first driving means, said second driving means comprising a second motor for rotating said second distributor roll and said plate cylinder; and a swing roll for transferring ink between said first distributor roll and said second distributor roll, said swing roll being movable between an engaged position in ink transferring relationship with both of said distributor rolls and a disengaged position in ink transferring relationship with only one of said distributor rolls.

9. A printing apparatus as defined in claim 8 further comprising means for holding said swing roll in said disengaged position at each of a plurality of successive times that said ductor roll is moved into said second position, and for moving said swing roll into said engaged position at each of a plurality of times between said successive times that said ductor roll is moved into said second position.

10. A printing apparatus as defined in claim 8 wherein said swing roll is supported in continuous ink transferring relationship with said first distributor roll.

11. A printing apparatus as defined in claim 10 wherein said swing roll is supported in rolling surface engagement with said first distributor roll when in said disengaged position.

12. A printing apparatus as defined in claim 8 wherein said first driving means includes a first gear means for rotating said first distributor roll and said swing roll.

13. A printing apparatus as defined in claim 8 wherein said swing roll is supported in continuous ink transferring relationship with said second distributor roll.

14. A printing apparatus as defined in claim 13 wherein said second driving means includes a second gear means for rotating said second distributor roll and said swing roll.

15. A printing apparatus comprising:

an ink fountain for containing a quantity of ink;

a fountain roll for picking up ink from said ink fountain;

a first distributor roll;

a movable ductor roll for transferring ink from said fountain roll to said first distributor roll, said ductor roll having a first position in rolling engagement with said fountain roll to be rotated by said first distributor roll at a first speed, said ductor roll having a second position spaced from said fountain roll and in rolling engagement with said first distributor roll to be rotated by said first distributor roll at a second speed greater than said first speed, said ductor roll being supported in continuous ink transferring relationship with said first distributor roll;

means for moving said ductor roll between said first and second position;

a second distributor roll for receiving ink from said first distributor roll, said second distributor roll being spaced from said first distributor roll;

a plate cylinder for carrying an image to be printed and to which ink from said ink fountain is transferred by said fountain roll, said ductor roll, and said first and second distributor rolls;

a first driving means comprising a first motor for rotating said first distributor roll;

a second driving means separated from said first driving means, said second driving means comprising a second motor for rotating said second distributor roll and said plate cylinder; and a swing roll for transferring ink between said first distributor roll and said second distributor roll, said swing roll being supported in continuous ink transferring relationship with said first distributor roll, said swing roll being movable between a disengaged position not in ink transferring relationship with said second distributor roll and an engaged position in ink transferring relationship with said second distributor roll.

16. A printing apparatus as defined in claim 15 further comprising means for holding said swing roll in said disengaged position at each of a plurality of successive times that said ductor roll is moved into said first position, and for moving said swing roll into said engaged position at each of a plurality of times between said successive times that said ductor roll is moved into said first position.

17. A printing apparatus as defined in claim 16 wherein said holding means comprises a frame for supporting said ductor roll and said swing roll in ink transferring relationship with said first distributor roll, said frame being pivotal about the axis of said first distributor roll, said moving means pivotally moving said frame about said axis to move said ductor roll and said swing roll between said positions.

* * * * *

UNITED STATES PATENT AND TRADEMARK OFFICE

CERTIFICATE OF CORRECTION

PATENT NO. : 5,152,224

DATED : October 6, 1992

INVENTOR(S) : Glenn A. Guaraldi

It is certified that error appears in the above-identified patent and that said Letters Patent is hereby corrected as shown below:

Column 12, Line 37, Claim 15, change "between" to --from--.

Column 12, Line 38, Claim 15, change "and" to --to--.

Signed and Sealed this

Nineteenth Day of October, 1993

*Attest:*

*Attesting Officer*

BRUCE LEHMAN

*Commissioner of Patents and Trademarks*